US008651042B2

(12) United States Patent
Kosemura et al.

(10) Patent No.: US 8,651,042 B2
(45) Date of Patent: Feb. 18, 2014

(54) OPERATION DEVICE

(75) Inventors: Atsushi Kosemura, Yokkaichi (JP); Yasushi Oonishi, Yokkaichi (JP); Yuusuke Yoshida, Yokkaichi (JP); Kenji Sakurai, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 162 days.

(21) Appl. No.: 13/257,551

(22) PCT Filed: Feb. 3, 2010

(86) PCT No.: PCT/JP2010/000632

§ 371 (c)(1),
(2), (4) Date: Sep. 19, 2011

(87) PCT Pub. No.: WO2010/106726

PCT Pub. Date: Sep. 23, 2010

(65) Prior Publication Data

US 2012/0195062 A1 Aug. 2, 2012

(30) Foreign Application Priority Data

Mar. 19, 2009 (JP) ..... 2009-068622

(51) Int. Cl.
*H01H 13/14* (2006.01)
*H01H 13/70* (2006.01)

(52) U.S. Cl.
USPC ..... 116/279; 116/DIG. 5; 116/DIG. 28; 362/23.05

(58) Field of Classification Search
USPC ..... 116/279, DIG. 5, DIG. 28; 16/DIG. 30; 200/5 R, 313, 314, 318.1, 333, 341, 200/345; 362/23.05, 581
See application file for complete search history.

(56) References Cited

U.S. PATENT DOCUMENTS

| | | | | |
|---|---|---|---|---|
| 4,394,546 | A * | 7/1983 | Harumatsu | 200/5 R |
| 5,813,519 | A * | 9/1998 | Gotoh | 200/313 |
| 7,439,458 | B2 * | 10/2008 | Montalvo | 200/4 |

FOREIGN PATENT DOCUMENTS

| | | |
|---|---|---|
| JP | U-06-080231 | 11/1994 |
| JP | A-2001-006474 | 1/2001 |
| JP | A-2001-325848 | 11/2001 |
| JP | A-2008-130276 | 6/2008 |

OTHER PUBLICATIONS

International Search Report issued in International Application No. PCT/JP2010/000632 dated Mar. 9, 2010.

* cited by examiner

*Primary Examiner* — R. A. Smith
(74) *Attorney, Agent, or Firm* — Oliff PLC

(57) ABSTRACT

An operation device comprises: a plurality of operation members attached to a common supporting member; and a plurality of inserting components having the same configurations with one another. The operation members include latching apertures for securing the inserting components to the operation members and include a plurality of kinds of structure to be attached to the common supporting member so that opening directions of the latching apertures are different from one another. The inserting components include a plurality of latching projections that protrude outward from a main body, and have configurations that can engage the latching apertures in any one of the operation members. The latching projections protrude from the main body in a plurality of directions corresponding to the opening directions of the latching apertures so that any one of the latching projections can engage the latching aperture in any one of the operation members.

6 Claims, 5 Drawing Sheets

OPERATION DEVICE

BACKGROUND

This invention relates to an operation device that includes operation members to be operated by a user and inserting components to be secured to the operation members.

For example, Patent Document 1 has disclosed such operation device including operation members that operate push buttons and light guides to be fixed in the operation members.

Specifically, the light guide extends in a particular direction. The light guide is provided on its upper surface with a latching projection that protrudes upward. Each operation member includes a cylindrical portion that surrounds the light guide. A rear end of the cylindrical portion serves as a latching portion that engages the light guide. The light guide is fixed in the operation member in an orientation that extends in right and left directions. That is, the light guide is inserted into the cylindrical portion of the operation member so that the light guide is oriented in the right and left directions. The latching projection is engaged with a rear end of an upper wall of the cylindrical portion of the operation member to be secured to the operation member.

There is a difficult case in the prior art operation device in engagement of the light guide with the upper wall of the cylindrical portion of the operation member on account of a structure and an arrangement of the operation member when the operation members and plural light guides to be secured to the operation members are assembled together to form the operation device. In this case, it is necessary to provide additional latching projections on the other positions on the light guides. That is, there is a problem that a plurality of light guides having different configurations from one another must be prepared and this will cause to lower productivity.

PATENT DOCUMENT 1: JUM HEI 6(1994)-80231 A

SUMMARY

Accordingly, an object of the present invention is to provide an operation device that can achieve high productivity regardless of the fact that the operation device is provided with plural operation members having different structures from one another.

In order to achieve the above object, an operation device in accordance with the present invention comprises: a plurality of operation members to be attached to a common supporting member; and a plurality of inserting components having the same configurations with one another, being adapted for common use to the operation members, and being secured to the operation members. The operation members are provided with latching apertures for securing the inserting components to the operation members. The operation members include a plurality of kinds of structure to be attached to the common supporting member so that opening directions of the latching apertures are different from one another. Each of the inserting components includes a main body, and a plurality of latching projections that protrude outward from the main body, and have configurations that can engage the latching apertures in any one of the operation members. The inserting components are secured to the operation members when the latching projections engage the latching apertures. The latching projections protrude from the main body in a plurality of directions corresponding to the opening directions of the latching apertures in the operation members so that any one of the latching projections can engage the latching aperture in any one of the operation members when each of the inserting components is disposed in a common particular orientation for each of the operation members.

According to the above operation device, it is possible to enhance productivity by enabling the inserting components to achieve a commonality of configurations regardless the fact that the operation device has a plurality of different kinds of operation member, to which the inserting components are secured, thereby enhancing productivity.

DETAILED DESCRIPTION OF EMBODIMENTS

Figure 1:
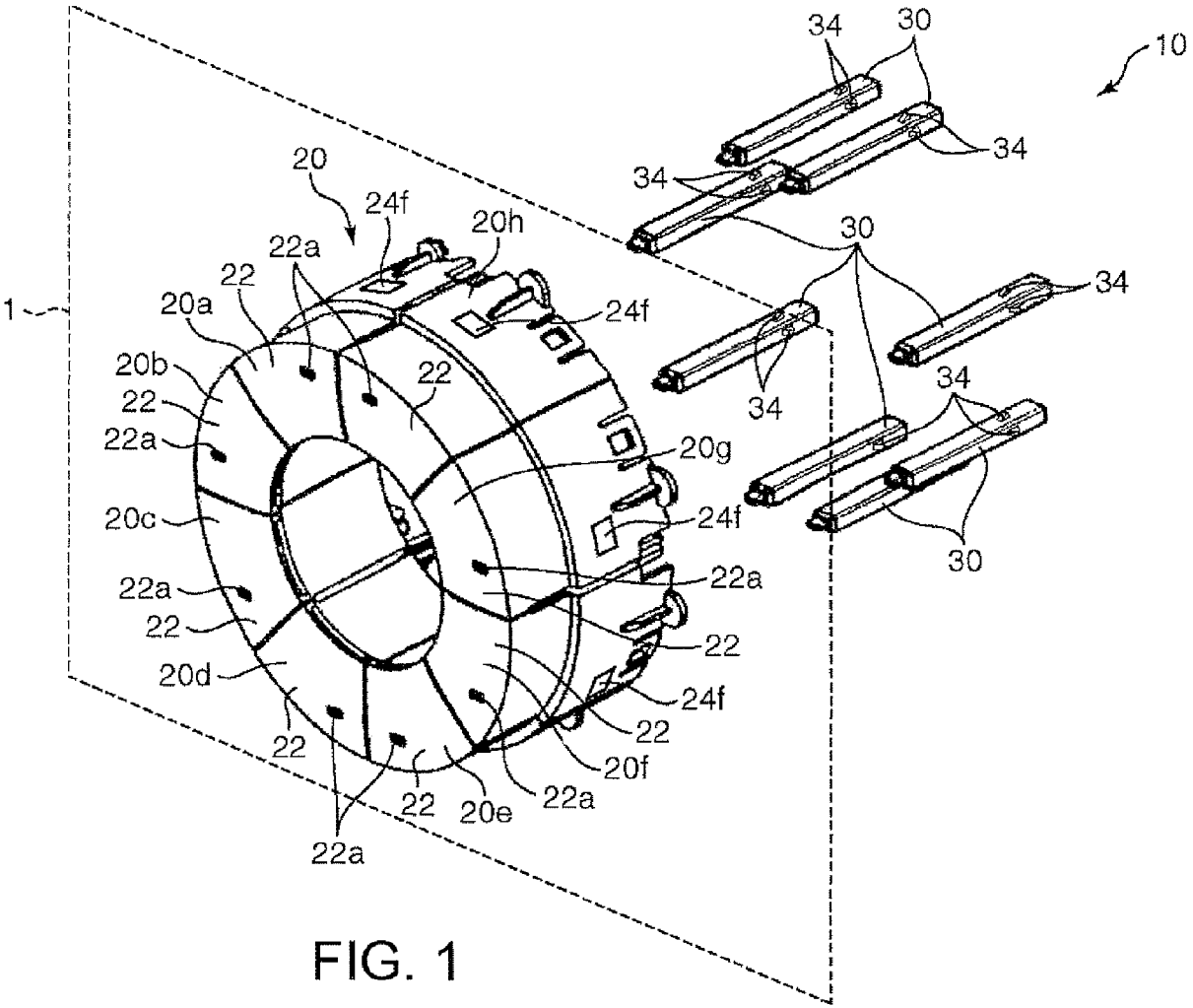
FIG. 1 is an exploded schematic perspective view of an operation device in accordance with the present invention.

Referring now to the drawings, preferred embodiments will be described below.

Hereinafter, a case where an operation device 10 of the present invention is attached to a vehicle instrument panel (a supporting member) 1 will be explained.

Figure 2:
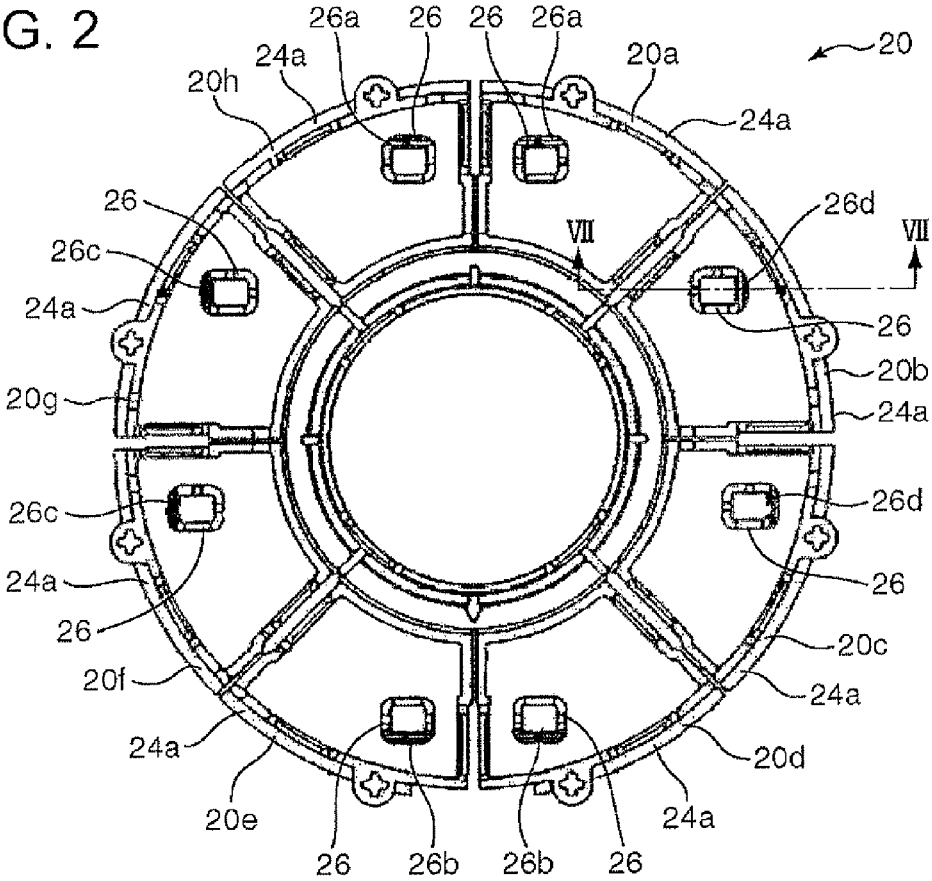
FIG. 2 is a rear side elevation view of the operation device shown in FIG. 1.
Figure 3:
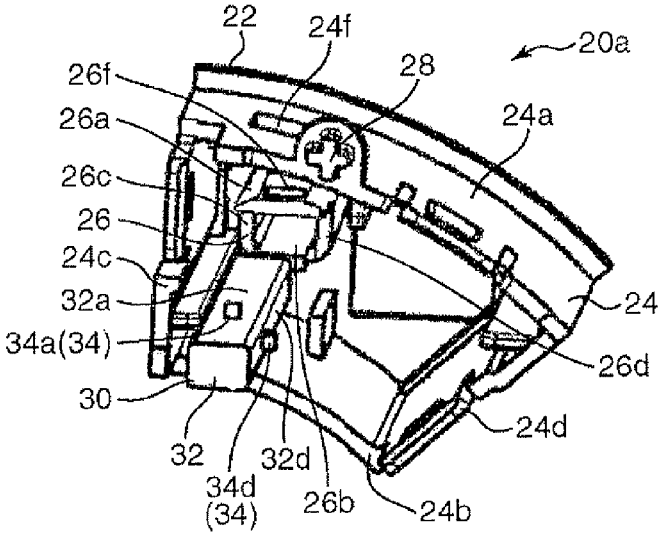
FIG. 3 is an exploded schematic perspective view of a part of the operation device shown in FIG. 1.
Figure 4:
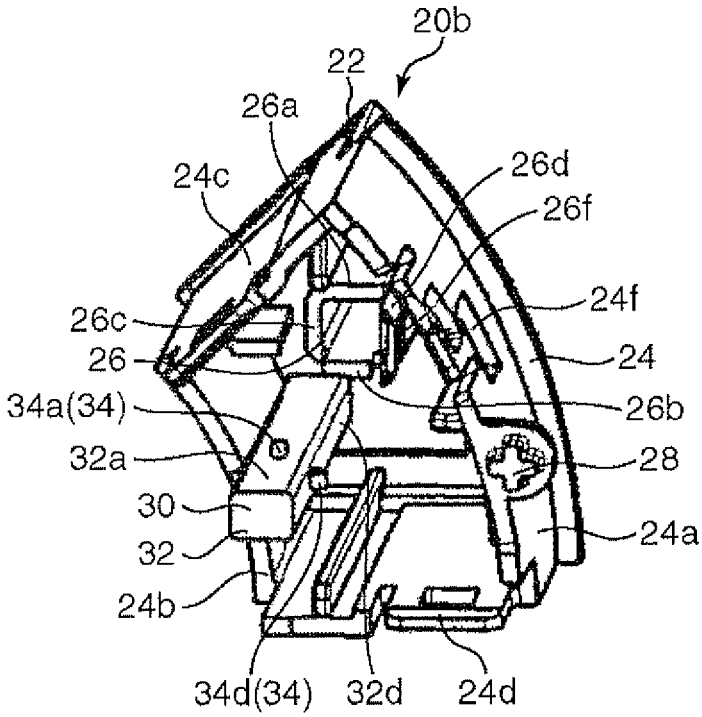
FIG. 4 is an exploded schematic perspective view of a part of the operation device shown in FIG. 1.

FIG. 1 is an exploded schematic perspective view of the operation device 10. FIG. 2 is a rear side elevation view of the operation device 10. FIGS. 3 and 4 are rear side elevation views of a part of the operation device 10 shown in FIG. 1.

The operation device 10 includes eight push buttons (operation members) 20 (20*a*, 20*b*, 20*c*, 20*d*, 20*e*, 20*f*, 20*g*, 20*h*), and eight light guides (inserting components) 30 that are secured to the push buttons 20, respectively. Each light guide 30 serves to guide lights from a light source for illumination 40 (see FIG. 7) to a surface on each push button 20. The light guides 30 have the same configurations and structures with one another and are secured to the push buttons 20 in common.

Each push button 20 serves to actuate a switch element (not shown) by means of a pressing operation. As shown in FIG. 2, the push buttons 20 are attached to the instrument panel 1 so as to form a doughnut-like configuration in a circumferential direction of the panel 1. The respective push buttons 20 have the same structures with one another. As shown in FIGS. 3 and 4, each push button 20 includes a front panel 22, an outer wall 24, a light guide holder 26, and a pressing portion 28.

The front panel 22 is operated by a user. The front panel 22 is provided an indicator aperture 22*a* (see FIGS. 1 and 7) that penetrates the front panel 22 in front and rear directions. A prism section 33 (mentioned after) of the light guide 30 is inserted into the indicator aperture 22*a*. The indicator aperture 22*a* is formed into a substantially rectangular shape in cross section in accordance with a configuration of the prism section 33.

The outer wall 24 protrudes backward from an outer end of the front panel 22. Specifically, the outer wall 24 includes four wall portions, that is, an outer peripheral wall portion 24*a*, an inner peripheral wall portion 24*b*, an upper side wall portion 24*c*, and a lower wall portion 24*d*. The outer peripheral wall portion 24*a* is disposed at an outer side in a radial direction and extends in a peripheral direction when the push button 20 is attached to the instrument panel 1. The inner peripheral wall portion 24*b* is disposed at an inner side in the radial direction and extends in the peripheral direction under the above state. The upper wall portion 24*c* extends in the radial direction between an upper end of the outer peripheral wall portion 24*a* and an upper end of the inner peripheral wall portion 24*b*. The lower wall portion 24*d* extends in the radial direction between a lower end of the outer peripheral wall portion 24*a* and a lower end of the inner peripheral wall portion 24*b*.

The pressing portion 28 serves to transmit an operation force applied to the front panel 22 to the switch element so as to actuate the switch element by means of a pressing action. The pressing portion 28 further protrudes backward from a rear end surface of the outer peripheral wall portion 24*a* of the outer wall 24. When the front panel 22 is pressed, the pressing portion 28 slides backward so as to actuate the switch element by means of the pressing action.

The light guide holder 26 serves to hold the light guide 30. The light guide holder 26 is provided on an area surrounded by the outer wall 24. The light guide holder 26 is formed into a substantially rectangular tube and extend backward from a portion surrounding the indicator aperture 22*a* in a rear side surface of the front panel 22. When the light guide 30 is inserted into the light guide holder 26, it holds the light guide 30 at a rear side of the front panel 22. The light guide holder 26 includes four holding walls, that is, an upper holding wall 26*a*, a lower holding wall 26*b*, a right holding wall 26*e*, and a left holding wall 26*d*. When the push button 20 is attached to the instrument panel 1 and the light guide 30 is inserted into the inner side of the light guide holder 26, the upper holding wall 26*a* is disposed above the light guide 30 and extends in right and left directions. The lower holding wall 26*b* is disposed below the light guide 30 and extends in the right and left directions under the above state. The right holding wall 26*c* extends in upper and lower directions between a right end of the upper holding wall 26*a* and a right end of the lower holding wall 26*b*. The left holding wall 26*d* extends in the upper and lower directions between a left end of the upper holding wall 26*a* and a left end of the lower holding wall 26*b*.

One of the four holding walls of the light guide holder 26 is provided with a latching aperture 26*f* that penetrates the holding wall in front and rear side directions. The latching aperture 26*f* engages a latching projection 34 (mentioned after) of the light guide 30. When the latching projection 34 engages the latching aperture 26*f*, the light guide 30 is secured to the inner side of the light guide holder 26. Opening directions of the latching aperture 26*f* and the holding wall provided with the latching aperture 26*f* are different in accordance with an attaching position of the push button 20.

The light guide holder 26 is provided on an area surrounded by the outer wall 24 of the push button 20. Consequently, in the case where the light guide holder 26 and outer wall 24 are molded integrally from resin in, for example, a mold and the latching aperture 26*f* is formed in the light guide holder 26, it is necessary to form an aperture for forming the latching aperture 26*f* in the outer wall 24 on account of a mold structure. However, the upper wall portion 24*c* and lower wall portion 24*d* of the outer wall 24 are disposed adjacent to the other push buttons 20. Consequently, if the apertures are formed in these wall portions, there is a problem that lights leaked from the apertures will illuminate the other push buttons 20 unsuitably. The inner peripheral wall portion 24*b* of the outer wall 24 is opposed to the inner peripheral wall portion 24*b* of the other push button 20. Consequently, if the aperture is formed in the inner peripheral wall 24*b*, the leaked lights will also illuminate the other push buttons 20 unsuitably. Accordingly, in the operation device 1 of the present invention, the aperture 24*f* for forming the latching aperture is provided in the outer peripheral wall portion 24*a* of the outer wall 24. The latching aperture 26*f* is provided in the holding wall near the outer peripheral wall portion 24*a*, in which the aperture 24*f* for forming the latching aperture is provided, so as to be open toward the outer peripheral wall portion 24*a*.

The outer peripheral wall portion 24*a* extends along the peripheral direction of the push button 20. Consequently, directions of the outer peripheral wall portion 24*a* of each push button 20 are different with respect to upper and lower and right and left directions in accordance with a position of attaching the push button 20. Thus, the opening directions of the latching aperture 26*f* and the holding wall, in which the latching aperture 26*f* is provided, are different on account of each push button 20.

Specifically, in the first upper push button 20*a* and eighth push button 20*h* out of the eight push buttons 20, each outer peripheral wall portion 24*a* is disposed on an upper end side of the front panel 22 and extends substantially in a horizontal direction. In the first upper push button 20*a* and eighth push button 20*h*, the latching aperture 26*f* is provided so that the aperture 26*f* is open toward upper and lower directions in the upper holding wall 26*a* out of the holding walls. On the other hand, in the second push button 20*b* and third push button 20*c* that are attached to the instrument panel 1 on the left side near a central part in the upper and lower directions, each outer peripheral wall portion 24*a* is disposed on a left end side of the front panel 22 and extends substantially in a vertical direction. Thus, in the second push button 20*b* and third push button 20*c*, the latching aperture 26*f* is provided so that the aperture 26*f* is open toward right and left directions in the left holding wall 26*d* out of the holding walls. Similarly, in the fourth push button 20*d* and fifth push button 20*e*, each latching aperture 26*f* is provided in the lower holding wall 26*b* so as to be open in the upper and lower directions. In the sixth push button 20*f* and seventh push button 20*g*, each latching aperture 26*f* is provided in the right holding wall 26*c* so as to be open in the right and left directions.

Figure 7:
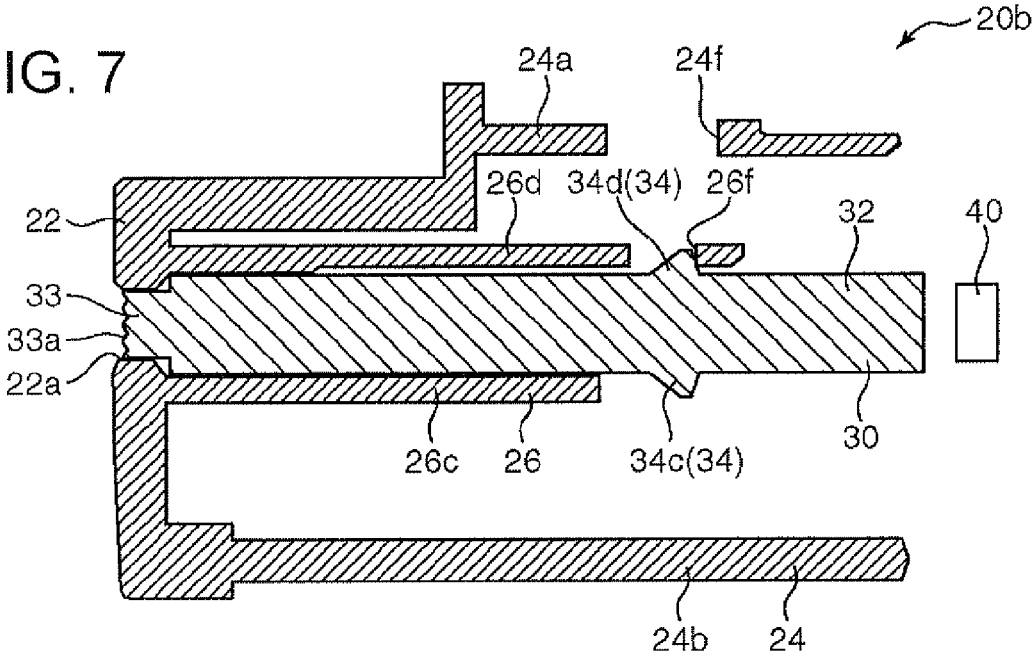
FIG. 7 is a cross section view of the operation device taken along lines VII-VII in FIG. 2.

As shown in FIG. 7, a length in front and rear directions of each non-latching wall of the holding walls, in which the latching aperture 26*f* is not provided, is shorter than a length of the latching wall in which the latching aperture 26*f* is provided. Rear ends of the non-latching walls are disposed at a front side beyond the latching aperture 26*f*.

Figure 5:
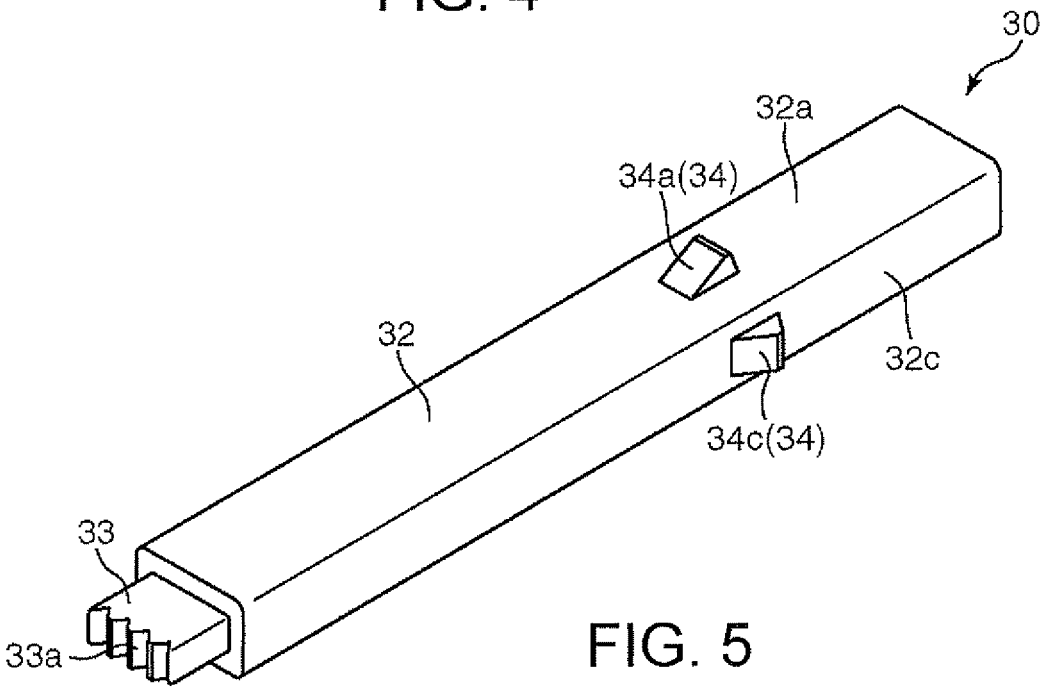
FIG. 5 is a schematic perspective view of a light guide for the operation device shown in FIG. 1.
Figure 6:
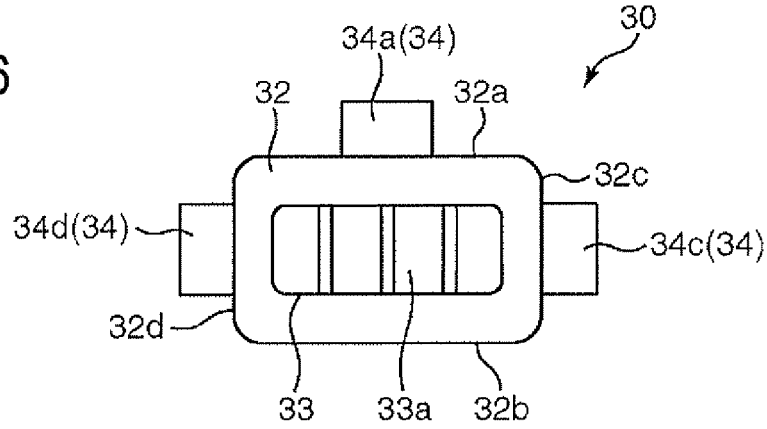
FIG. 6 is a front elevation view of the light guide shown in FIG. 5.
Figure 8:
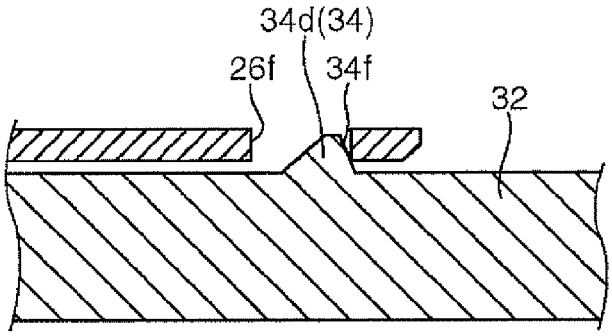
FIG. 8 is a partially enlarged cross section view of the operation device shown in FIG. 7.
Figure 9:
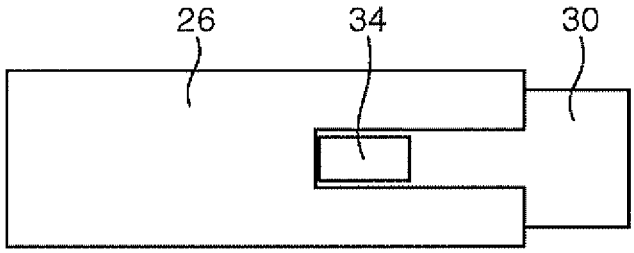
FIG. 9 is a plan view of a part of the operation device in another embodiment, illustrating a structure that is constructed to avoid a contact between a latching projection and a non-latching wall.

As described above, the light guide 30 serves to guide the lights from the illuminating light source to the front side of the pushing button 20. The illuminating light source is turned on and off, for example, in response to an output from the switch element. The light guide 30 includes a light guide main body (main body) 32 and latching projections 34. FIG. 5 is a schematic perspective view of the light guide 30. FIG. 6 is a front elevation view of the light guide 30. FIGS. 7 to 9 are cross section views and a plan view of the light guide 30, illustrating the light guide 30 secured to the pushing button 20.

The light guide main body 32 is formed into a substantially rectangular parallelepiped configuration that extends in front and rear directions. The light guide main body 32 includes a pair of long side surfaces 32*a*, 32*b* and a pair of short side surfaces 32*c*, 32*d* (see FIG. 5). The sides 32*a* to 32*d* define a rectangular shape in cross section. The light guide main body 32 is provided on a front portion with a prism section 33 that serves as an indicator. The prism section 33 is formed into a rectangular parallelepiped configuration. Long sides of the rectangular cross section of the prism section 33 extend in the same direction as a long side direction of the light guide main body 32. When the light guide 30 is inserted into the inner side of the light guide holder 26, the prism section 33 is inserted into the indicator aperture 22*a*. A front end surface 33*a* of the prism section 33 is exposed outward to serve as a light-emitting surface. The prism section 33 is provided on a front end surface 33*a* with a plurality of slits that are juxtaposed in the long side direction of the light guide main body 32. The lights from the illuminating light source are diffused in the front end surface 33*a* in the long side direction of the prism section 33.

The latching projection 34 engages the latching aperture 26*f* provided in the light guide holder 26. Upon engagement of the projection 34 with the aperture 26*f*, the prism section 33 is inserted into the indicator aperture 22*a* and the light guide 30 is fixed in the light guide holder 26. In the operation device 1 of the present embodiment, three latching projections 34 (a first latching projection 34*a*, a second latching projection 34*c*, and a third latching projection 34*d*) are provided on each light guide 30 (see FIG. 6). Each of the latching projections 34*a* to 34*c* protrudes outward from each side surface of the light guide main body 32. Specifically, the first latching projection 34*a* is provided on one (32*a*) of the long side surfaces 32*a* and 32*b* of the light guide main body 32. The second latching projection 34*c* and third latching projection 34*d* are provided on the short side surfaces 32*c* and 32*d* of the light guide main body 32. These latching projections 34*a*, 34*c*, and 34*d* are disposed at the same distances from the front end surface of the light guide main body 32.

In the present embodiment in which the operation device 10 is attached to the instrument panel 1, in order that the indicator can give a high indicating effect to a driver or the like, it is required that the lights from the illuminating light source are diffused in the horizontal direction in the prism sections 33 and amounts of light-emission from the prism sections 33 in the push buttons 20 are uniform. Accordingly, each light guide 30 must be secured to each push button 20 so that the long side surfaces of all light guide main bodies 32 are oriented to the upper and lower directions (herein after referred to a "particular orientation"). In the present embodiment, the prism section 33 and light guide main body 32 have the same configurations when they are turned by an angle of 180 degrees. Any one of the pair of long side surfaces may be directed upward.

On the other hand, as described above, in the operation device 10 of the present embodiment, the positions at the upper and lower and right and left directions of each holing wall of the light guide holder 26 in which the latching aperture 26*f* is provided and the opening direction of the latching aperture 26*f* are different every each push button 20. Consequently, in the prior art structure disclosed in Patent Document 1 in which the latching projection is provided on only one side surface of the light guide, two kinds of light guides must be prepared beforehand. The one kind of light guide is provided on the long side surface with the latching projection to be engaged with the latching aperture. The other kind of light guide is provided on the short side surface with the latching projection to be engaged with the latching aperture. The light guide corresponding to the push button must be secured to every push button. Consequently, in the prior art structure, two kinds of light guide must be produced, the light guide must be attached to every push button in accordance with the kind of push button. This will take much expense in time and effect for attachment.

On the contrary, according to the operation device 10 of the present embodiment, the light guide 30 is provided with three latching projections 34, the same kind of light guide 30 is used, and all light guides 30 can be fixed in the light guide holders 26 in the particular orientation. That is, as shown in FIG. 6, when the light guide 30 is disposed in the particular orientation, the first latching projection 34*a* protrudes upward, the second latching projection 34*c* protrudes to the right side, and the third latching projection 34*d* protrudes to the left side. Accordingly, even if the latching aperture 26*f* is provided in any one of the upper holding wall 26*a*, right holding wall 26*c*, and left holding wall 26*d*, the latching projection 34 can engage the latching aperture 26*f* while maintaining the particular orientation of the light guide 30. It is also possible to engage the first latching projection 34*a* with the latching aperture 26*f* provided in the lower holding wall 26*b* by turning the light guide 30 by an angle of 180 degrees to protrude the first latching projection 34*a* downward. As described above, since the light guide main body 32 can keep the same configuration even if the light guide 30 is turned by the angle of 180 degrees, it is possible in this case to maintain the light guide 30 in the particular orientation.

Thus, it is possible in the operation device 10 of the present embodiment for the prism section 33 to diffuse the lights from the illuminating light source in the horizontal direction and for all push buttons 20 to uniform amounts of light emission of the prism sections without producing many kinds of light guide 30. It is possible to readily secure the light guide 30 to each push button 20 and to save much expense in time and effect for attachment by utilizing the same kind of light guide 30.

As described above, the rear end of the non-latching wall out of the holding walls of the light guide holder 26 is disposed at a front side beyond the latching aperture 26*f*. The non-latching wall is not provided with the latching aperture 26*f*. As shown in FIG. 7, when the light guide 30 is inserted into the light guide holder 26, it is possible to avoid a contact between the non-latching wall and the latching projection 34 that is not engaged with the latching projection 26*f*. Since the contact between them is avoided, it is possible to restrain the light guide 30 from rattling in the light guide holder 26. Also, since the contact between them is avoided, the light guide 30 can be readily inserted into the light guide holder 26.

Another detailed configuration of each latching projection is not limited, so long as each latching projection 34 protrudes outward from each side surface of the light guide main body 32 and the light guide 30 is fixed in the light guide holder 26 when the latching projection 34 engages the latching aperture 26*f*. However, as shown in FIG. 8, in the operation device 10 of the present embodiment, the latching projection 34 is inclined so as to increase an amount of protruding from each side surface of the light guide main body 32 as the rear end surface 341 of the latching projection 34 is changed forward and it is possible to restrain the light guide 30 from rattling in the light guide holder 26. That is, if the rear end surface 34*f* of the latching projection 34 is inclined in the above manner, when the rear end surface 34*f* contacts with the holding wall of the light guide holder 26 in the front and rear directions, a force opposite from the protruding direction in addition to a frontward force is applied to the latching projection 34. Consequently, it is possible to restrain the light guide 30 from rattling in the protruding direction in the light guide holder 26.

As described above, in the operation device 10 of the present embodiment, the light guide 30 is provided with a plurality of latching projections that protrude in different directions from one another in correspondence with the different opening directions of the latching apertures 261 in accordance with the push buttons 20. When the latching projection 34 corresponding to the opening direction of the latching aperture 26*f* engages the latching aperture 26*f*, it is possible to secure each light guide 30 to each push button 20 in the same orientation.

Each latching projection 34 may be provided on only any one of the long side surfaces 32*a* and 32*b* of the light guide main body 32 and on only any one of the short side surfaces 32*c* and 32*d* of the light guide main body 32. Each latching projection 34 may be provided on all side surfaces of the light guide main body 32. However, in the case where the light guide 30 maintains the same configuration even if the light guide 30 is turned by an angle of 180 degrees, each latching projection 34 may be provided on only any one of the long side surfaces 32*a* and 32*b* and on only any one of the short side surfaces 32*c* and 32*d*, thereby reducing the number of the latching projections 34.

The light guide holder 26 may be omitted. However, if the light guide holder 26 is provided in the push button 20 and the latching aperture 26*f* is provided in the holding wall that constitutes the light guide holder 26, it is possible to positively engage the latching projection 34 with the latching aperture 26*f* while maintaining the light guide 30 in the particular orientation by inserting the light guide 30 into the light guide holder 26.

A specific structure for avoiding the contact between the non-latching wall and the latching projection that does not engage the latching aperture 26*f* in the light guide holder 26 is not limited to the above construction. For example, as shown in FIG. 9, the non-latching wall may have the same length as that of the latching wall and a portion of the non-latching wall opposed to the latching projection 34 may be cut out forward, thereby avoiding the above contact.

A specific structure of the light guide main body 32 is not limited to the above configuration. For example, a cross section of the light guide main body 32 may be formed into other polygonal shape. The polygonal shape may be any configuration, even if the light guide main body does not maintain the same configuration by being turned by an angle of 180 degrees.

The operation members in the present invention are not limited to the push buttons 20. The inserting components in the present invention are not limited to the light guides 30.

As described above, an operation device in accordance with the present invention comprises: a plurality of operation members to be attached to a common supporting member; and a plurality of inserting components having the same configurations with one another, being adapted for common use to the operation members, and being secured to the operation members. The operation members are provided with latching apertures for securing the inserting components to the operation members. The operation members include a plurality of kinds of structure to be attached to the common supporting member so that opening directions of the latching apertures are different from one another. Each of the inserting components includes a main body, and a plurality of latching projections that protrude outward from the main body, and have configurations that can engage the latching apertures in any one of the operation members. The inserting components are secured to the operation members when the latching projections engage the latching apertures. The latching projections protrude from the main body in a plurality of directions corresponding to the opening directions of the latching apertures in the operation members so that any one of the latching projections can engage the latching aperture in any one of the operation members when each of the inserting components is disposed in a common particular orientation for each of the operation members.

According to the operation device of the present invention, it is possible to achieve commonality of the inserting components, thereby enhancing productivity, even if the opening directions of the latching apertures in the operation members are different from one another and the inserting components must be secured to the operation members in the common orientation. That is, since the latching projections protrude in plural directions in correspondence with the opening directions of the plural latching apertures in the operation device and the latching projections corresponding to the opening directions engage the latching apertures, it is possible to maintain the inserting components in the common orientation regardless of the operation members.

Preferably, the main body of each of the inserting components includes a pair of long side surfaces and a pair of short side surfaces that define a substantially rectangular shape in cross section so that the main body maintains the same configuration even if the main body is turned by an angle of 180 degrees. Each of the latching projections protrudes from at least one of the two long side surfaces of the main body and from at least one of the two short surfaces of the main body. According to this structure, it is possible to maintain the inserting components in the common orientation while using the common inserting components for maximum four kinds of operation member in which the opening directions of the latching apertures are different every an angle of 90 degrees.

Furthermore, preferably, each of the latching projections protrudes from only one of the side surfaces in at least one out of the pair of long side surfaces and the pair of short side surfaces. According to this structure, it is possible to maintain the main body of each of the inserting components in the same orientation in the operation member by turning the inserting component by an angle of 180 degrees, even if a part of latching projections is omitted. Accordingly, it is possible to secure the inserting components to the operation members without causing any trouble while reducing the number of latching projections.

Also, preferably, each of the operation members includes a plurality of holding walls having inner side surfaces that are opposed to the long side surfaces and the short side surfaces on the main body of each of the inserting components, respectively. Any one of the plural holding walls is a latching wall provided with the latching aperture. Each of the inserting components includes each of the latching projections at a position where the latching projection can engage the latching aperture in the latching wall when the main body of each of the inserting components is inserted into an area surrounded by the holding walls. According to this structure, it is possible to positively engage the latching projection with the latching aperture to maintain the inserting component in the particular orientation by inserting the inserting component into the area surrounded by the holding walls.

Also, preferably, one of the holding walls is a non-latching wall except the latching walls. The non-latching wall is provided with a cut-out portion that has a configuration to avoid a contact between one of the latching projections on each of the inserting components and the non-latching wall when any one of the latching projections except the one latching projection that does not contact with the non-latching wall is engaged with the latching aperture. According to this structure, it is possible to avoid the contact between the latching projection that is not engaged with the latching aperture and the non-latching wall and to stably hold the inserting component in the holder.

Preferably, for example, the plural operation members include a plurality of push buttons that are arranged in a peripheral direction and are attached to the supporting member at positions where pushing actions can be applied to the pushing buttons. The inserting components include a plurality of light guides that have light-emission surfaces provided with a plurality of slits juxtaposed in a long side direction of the main body and that constitute indicators for the operation members. Each of the push buttons includes outer walls surrounding the holding walls. Each of the outer walls is provided with an outer peripheral wall that extends in a peripheral direction and is disposed outward in a radial direction when the push buttons are attached to the supporting member. The latching aperture is provided in the holding wall near the outer peripheral wall when the push buttons are attached to the supporting member. Each of the light guides is secured to each of the operation members so that the long side surfaces of the main body are oriented in upper and lower directions. In this case, when each push button is attached to the supporting member, each outer wall includes the outer peripheral wall that is disposed outward in the radial direction and extends in the peripheral direction. When each push button is attached to the supporting member, the latching aperture may be provided in the holding wall near the outer peripheral wall.

According to this structure, it is possible to fix all of the inserting components in the operation members so that the long side surfaces of the inserting components are oriented in the upper and lower directions and the slits are oriented in the horizontal direction while arranging the push buttons in the peripheral direction and to uniformly diffuse the lights in the indicators of the push buttons in the horizontal direction, thereby enhancing an indicating effect.

The invention claimed is:

1. An operation device comprising:

a plurality of operation members to be attached to a common supporting member; and a plurality of inserting components having the same configurations with one another and secured to said operation members;

said operation members including latching apertures for securing said inserting components to said operation members;

said operation members including a plurality of kinds of structure to be attached to said common supporting member so that opening directions of said latching apertures are different from one another;

each of said inserting components including a main body, and a plurality of latching projections that protrude outward from said main body, and have configurations that can engage said latching apertures in any one of said operation members, said inserting components being secured to said operation members when said latching projections engage said latching apertures; and said latching projections protruding from said main body in a plurality of directions corresponding to said opening directions of said latching apertures in said operation members so that any one of said latching projections can engage said latching aperture in any one of said operation members when each of said inserting components is disposed in a common particular orientation for each of said operation members.

2. An operation device according to claim 1, wherein said main body of each of said inserting components includes a pair of long side surfaces and a pair of short side surfaces that define a substantially rectangular shape in a cross section so that said main body maintains the same configuration even if said main body is turned by an angle of 180 degrees; and wherein each of said latching projections protrudes from at least one of said two long side surfaces of said main body and from at least one of said two short surfaces of said main body.

3. An operation device according to claim 2, wherein each of said latching projections protrudes from only one of said side surfaces in at least one out of said pair of long side surfaces and said pair of short side surfaces.

4. An operation device according to claim 2, wherein each of said operation members includes a plurality of holding walls having inner side surfaces that are opposed to said long side surfaces and said short side surfaces on said main body of each of said inserting components, respectively;

wherein any one of said plural holding walls is a latching wall provided with said latching aperture; and wherein each of said inserting components includes each of said latching projections at a position where said latching projection can engage said latching aperture in said latching wall when said main body of each of said inserting components is inserted into an area surrounded by said holding walls.

5. An operation device according to claim 4, wherein one of said holding walls is a non-latching wall, said non-latching wall is provided with a cut-out portion that has a configuration to avoid a contact between one of said latching projections on each of said inserting components and said non-latching wall when any one of said latching projections except said one latching projection that does not contact with said non-latching wall is engaged with said latching aperture.

6. An operation device according to claim 4, wherein said operation members include a plurality of push buttons that are arranged in a peripheral direction and are attached to said supporting member at positions where pushing actions can be applied to said pushing buttons, and said inserting components include a plurality of light guides that have light-emission surfaces provided with a plurality of slits juxtaposed in a long side direction of said main body and that constitute indicators for said operation members;

wherein each of said push buttons includes outer walls surrounding said holding walls;

wherein each of said outer walls is provided with an outer peripheral wall that extends in a peripheral direction and is disposed outward in a radial direction when said push buttons are attached to said supporting member;

wherein said latching aperture is provided in said holding wall near said outer peripheral wall when said push buttons are attached to said supporting member; and wherein each of said light guides is secured to each of said operation members so that said long side surfaces of said main body are oriented in upper and lower directions.

* * * * *